US010107058B2

(12) United States Patent
Misuraca et al.

(10) Patent No.: US 10,107,058 B2
(45) Date of Patent: Oct. 23, 2018

(54) ROV RETRIEVABLE REGULATOR MODULE

(71) Applicants: Mark L. Misuraca, The Woodlands, TX (US); William S. Averill, Cypress, TX (US); Simon Nockels, Cypress, TX (US); Nguyen Trinh, Houston, TX (US); Greg Boyle, Glendale, AZ (US); Robert A. Johnigan, Houston, TX (US); Kinton Lowell Lawler, Fulshear, TX (US); Nikunj M. Patel, Katy, TX (US); Michael Forrest Brune, Houston, TX (US); Michael S. Stonebraker, Houston, TX (US)

(72) Inventors: Mark L. Misuraca, The Woodlands, TX (US); William S. Averill, Cypress, TX (US); Simon Nockels, Cypress, TX (US); Nguyen Trinh, Houston, TX (US); Greg Boyle, Glendale, AZ (US); Robert A. Johnigan, Houston, TX (US); Kinton Lowell Lawler, Fulshear, TX (US); Nikunj M. Patel, Katy, TX (US); Michael Forrest Brune, Houston, TX (US); Michael S. Stonebraker, Houston, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 1040 days.

(21) Appl. No.: 13/772,050

(22) Filed: Feb. 20, 2013

(65) Prior Publication Data

US 2013/0213660 A1 Aug. 22, 2013

Related U.S. Application Data

(60) Provisional application No. 61/601,348, filed on Feb. 21, 2012.

(51) Int. Cl.
*E21B 29/12* (2006.01)
*E21B 33/035* (2006.01)
(Continued)

(52) U.S. Cl.
CPC ..... *E21B 33/035* (2013.01); *E21B 33/0355* (2013.01); *E21B 33/064* (2013.01); *E21B 41/04* (2013.01)

(58) Field of Classification Search
None
See application file for complete search history.

(56) References Cited

U.S. PATENT DOCUMENTS 4,784,525 A * 11/1988 Francois ..... B63C 11/52 166/338
5,046,895 A * 9/1991 Baugh ..... B63C 11/40 405/188

(Continued)

*Primary Examiner* — Matthew R Buck
*Assistant Examiner* — Douglas S Wood
(74) *Attorney, Agent, or Firm* — Maze IP Law, PC

(57) ABSTRACT

A retrievable module assembly can be used to install and/or de-install a blowout preventer (BOP) module from a BOP subsea where the BOP comprises one or more corresponding BOP module receivers. The retrievable module assembly typically comprises a frame configured to house and support the subsea BOP module; and a modular storage unit disposed at least partially within the frame. The modular storage unit further comprises a storage area configured to removably accept the subsea BOP module; a rotator configured to attach to and rotate the subsea BOP module, the rotator disposed at least partially within the frame; a rotator mover, slidably mounted in the frame and operatively in communication with the rotator; and a power connector operatively connected to the rotator and rotator mover and configured to interface with a power source.

19 Claims, 8 Drawing Sheets

(51) Int. Cl.

| | |
|---|---|
| ***E21B 33/064*** | (2006.01) |
| ***E21B 41/04*** | (2006.01) |
| ***E21B 7/128*** | (2006.01) |
| ***E21B 41/10*** | (2006.01) |
| ***B63C 11/00*** | (2006.01) |
| ***B63C 11/52*** | (2006.01) |

(56) References Cited

U.S. PATENT DOCUMENTS

| | | | | |
|---|---|---|---|---|
| 6,422,315 | B1 * | 7/2002 | Dean | E21B 33/0355 166/339 |
| 7,210,556 | B2 * | 5/2007 | Bath | G01V 1/16 181/104 |
| 9,487,280 | B2 * | 11/2016 | Jewell | B63C 1/12 |

* cited by examiner

ROV RETRIEVABLE REGULATOR MODULE

RELATION TO OTHER APPLICATIONS

This application relates to and claims the benefit of U.S. Provisional Application 61/601,348 filed on Feb. 21, 2012.

FIELD OF THE INVENTION

Many modules for use subsea with blowout preventer (BOP) stacks are either in use or contemplated and many such modules can be made modular. For example, a retrievable regulator module is a piece of subsea equipment that regulates fluids. Current regulators are installed, serviced, and replaced by technicians in a shop or field environment where long equipment downtime is unavoidable.

Further, most BOPs contain modules such as regulators that can only be retrieved by removing major components of the BOP or entire BOP itself, which is a long and time consuming process. The invention would be used in subsea environment particularly involving operation of subsea BOPs where drilling and completion of oil wells occur.

In the past, operators would rely on back-ups if the primary systems failed or on manual overrides. However, this is no longer allowed.

FIGURES

The figures supplied herein disclose various embodiments of the claimed invention.

DESCRIPTION OF VARIOUS EMBODIMENTS

Figure 1:
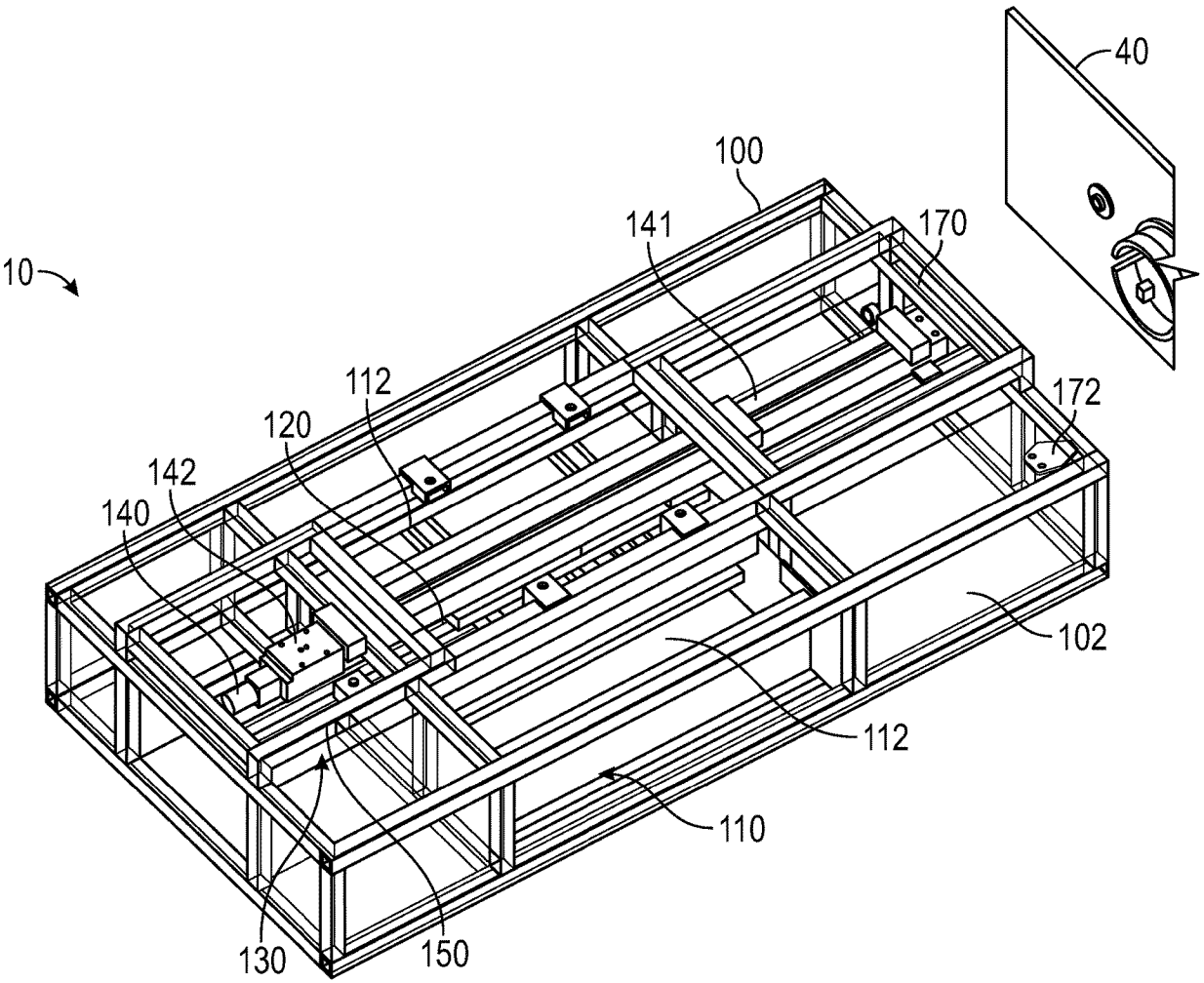
FIG. 1 is a diagram in partial perspective of an exemplary embodiment of a retrievable module assembly.
Figure 2:
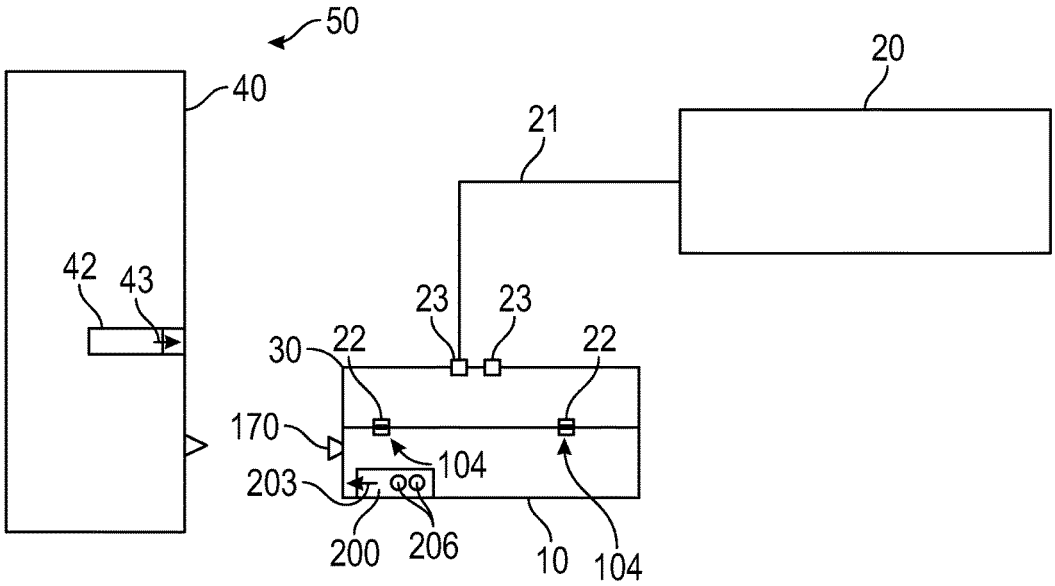
FIG. 2 is a block diagram of a system incorporating an exemplary embodiment of a retrievable module assembly.

Referring to FIG. 1, retrievable module assembly 10 comprises frame 100 configured to house and support one or more subsea BOP modules 120 such as BOP regulator replacement assembly 200 (FIG. 2); tray 110 configured to removably accept one or more subsea BOP modules 120; rotator 130 disposed at least partially within frame 100 and configured to attach to and rotate subsea BOP module 120; rotator mover 140, slidably mounted in frame 100 and operatively in communication with rotator 130; and power connector 150 operatively connected to rotator 130 and rotator mover 140. Retrievable module assembly 10 may further be configured to be maneuvered, including retrieved, using remotely operated vehicle (ROV) 20 (FIG. 2).

In certain embodiments, retrievable module assembly 10 further comprises connector 170 configured to secure retrievable module assembly 100 to a corresponding subsea structure for stability and alignment such as BOP 40. In other embodiments secondary docking lock 172, which may be conical, may be present to help lock or otherwise secure retrievable module assembly assembly 10 to BOP 40.

Retrievable module assembly 10 may further comprise one or more flotation modules 102 disposed at least partially within frame 100. Flotation module 102 is typically configured to provide additional buoyancy to retrievable module assembly 10.

Tray 110 may comprise a plurality of tray spaces 112 configured to removably accept a corresponding plurality of subsea modular units 200.

Rotator 130 is typically configured to selectively retrieve and/or install a subsea modular unit such as subsea BOP module 120 stored from a specific tray 110. Rotator 130 may also be used to move subsea BOP module 120 around inside retrievable module assembly 10 to an installation/retrieval position. Additionally, rotator 130 is typically configured to rotate subsea modular unit 120, once attached to that subsea BOP module 120. Where tray 110 comprises a plurality of trays 110, rotator 130 is typically configured to selectively attach to and rotate a predetermined one of the plurality of subsea BOP modules 120.

Rotator mover 140 may further comprise one or more rails 141 configured to slidably accept rotator mover 140, where motor 142 is operatively connected to rotator mover 140.

Each of rotator 130, rotator mover 140, and motor 142 may be powered by a power source operatively connected to power connector 150, the power source being installed in retrievable module assembly 10 or supplied by ROV 20 or ROV cage 30, or the like, or a combination thereof.

Referring additionally to FIG. 2, in certain embodiments subsea BOP module 120 comprises BOP regulator replacement assembly 200 configured to be installed into and/or replaced from BOP 40 with minimal disruption. BOP regulator replacement assembly 200 may be further configured to be fixedly mounted to BOP 40 or set up as a retrievable piece of equipment and installed in different types of BOP structures such as manifolds. Regulator 200 may be rated from around 3 kpsi to 5 kpsi and may be manual set and compensated.

In certain embodiments, frame 100 may further comprise mount 104 adapted to mate with corresponding mount receiver 22 mounted to a subsea transporter, e.g. to the bottom of ROV 20 or ROV cage 30 which may be attached to or otherwise connected to ROV 20. In other embodiments, frame 100 further comprises towline mount 23 adapted to mate with corresponding towline 21 connected to ROV 20 for subsea transportation.

System 50 for manipulating a blowout preventer subsea module comprises subsea BOP module 120 such as regulator replacement assembly 200 configured to be accepted into BOP module receiver 42 subsea, and retrievable module assembly 10, as described herein above.

Figure 3:
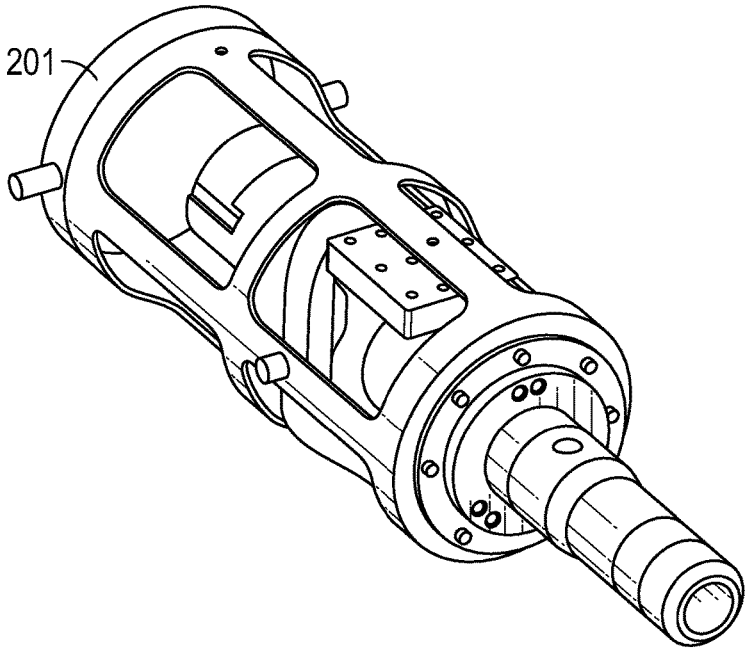
FIG. 3 is a planar view in partial perspective of an exemplary embodiment of a retrievable BOP module.
Figure 4:
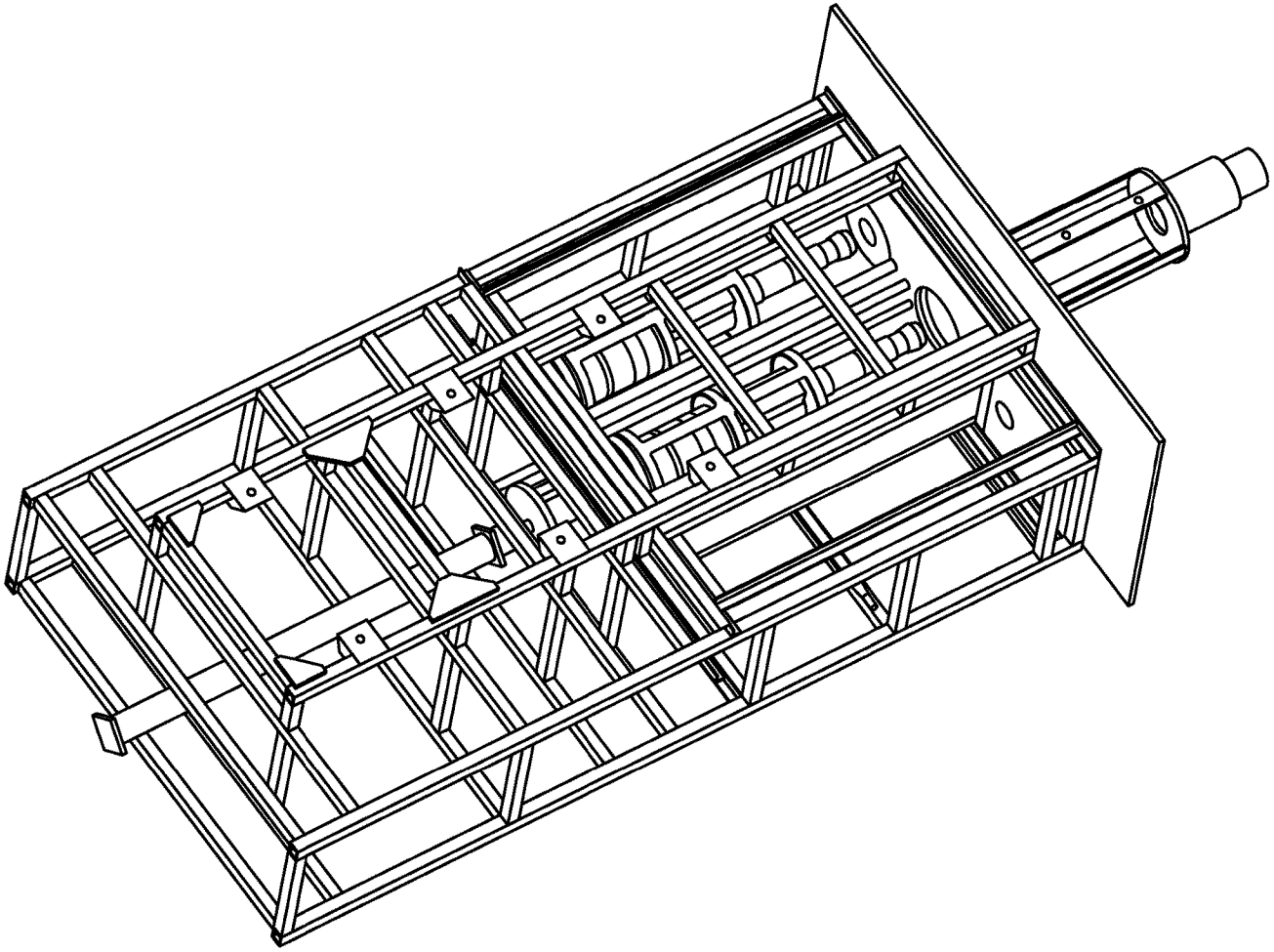
FIGS. 4-9 are views in partial perspective of an exemplary embodiment of a retrievable module assembly as it installs a retrievable BOP module.
Figure 5:
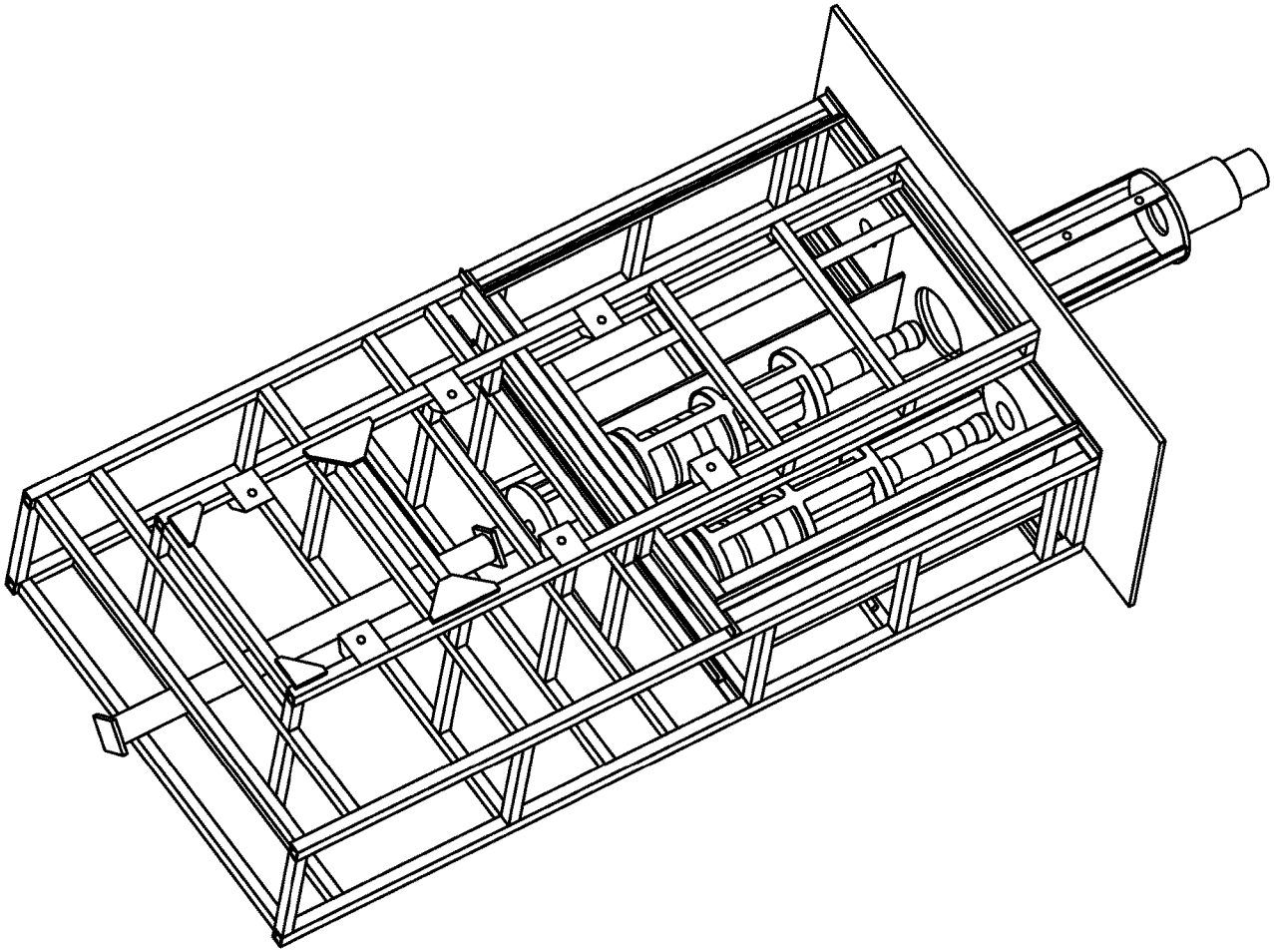
Figure 6:
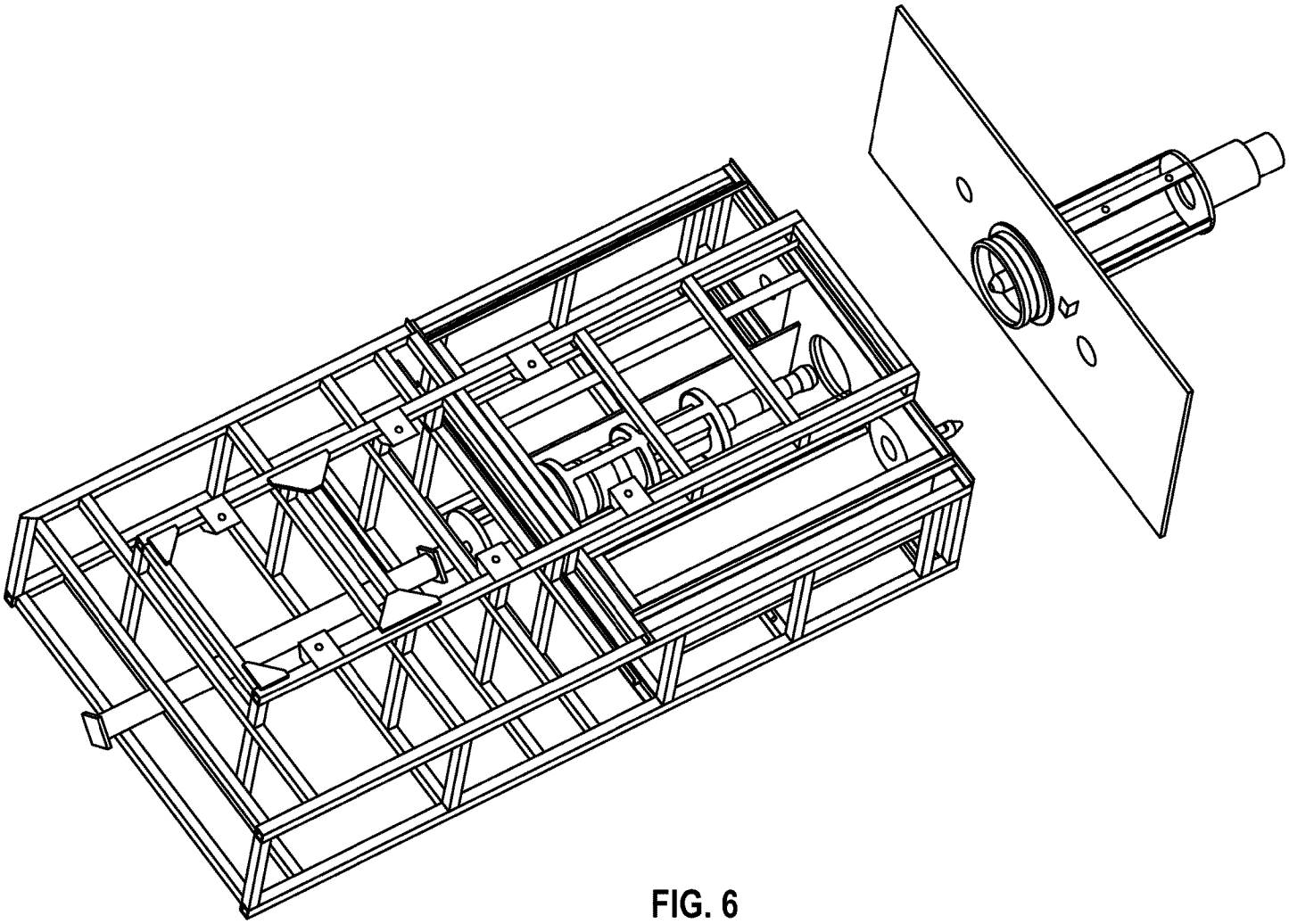
Figure 7:
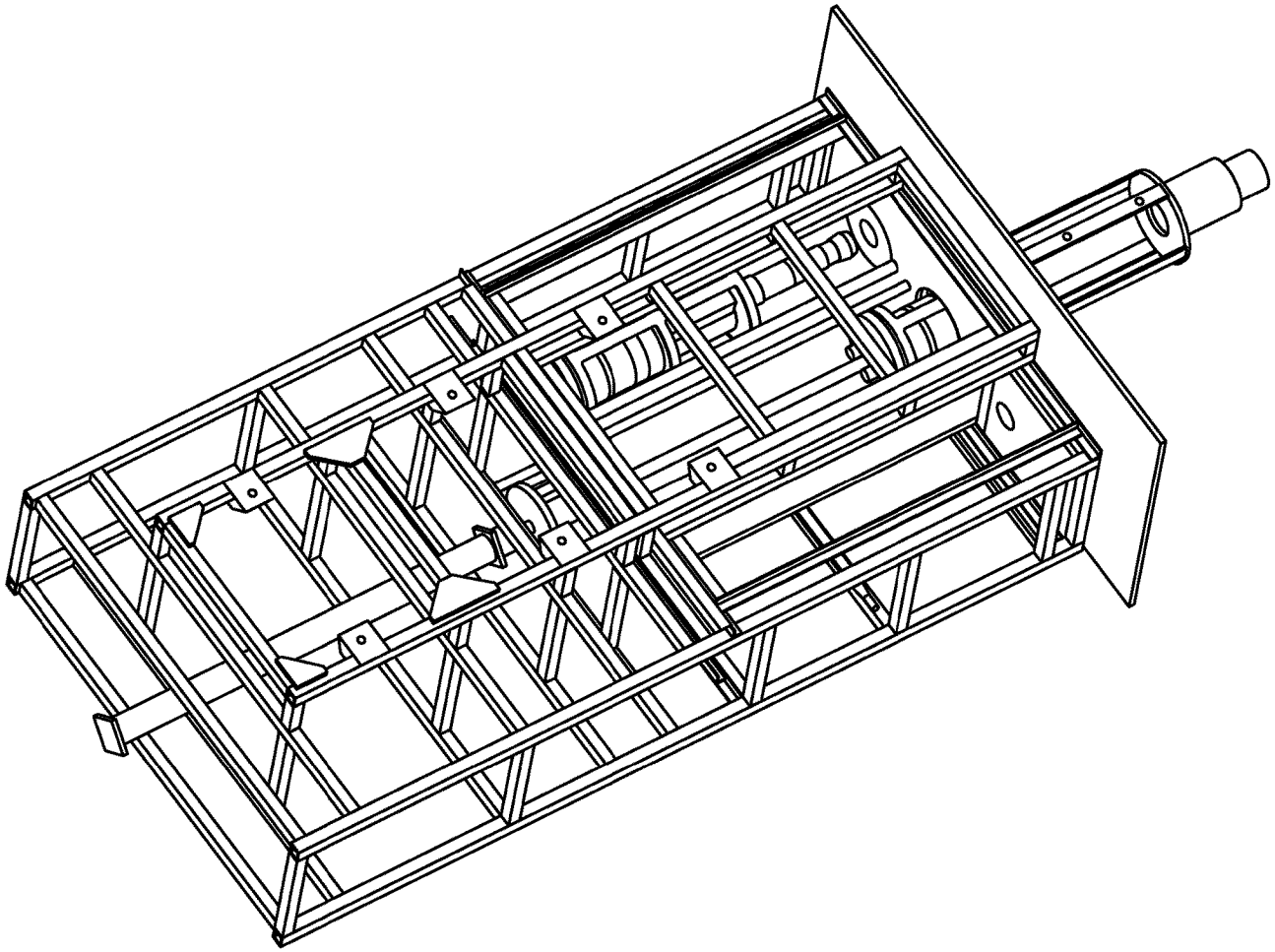
Figure 8:
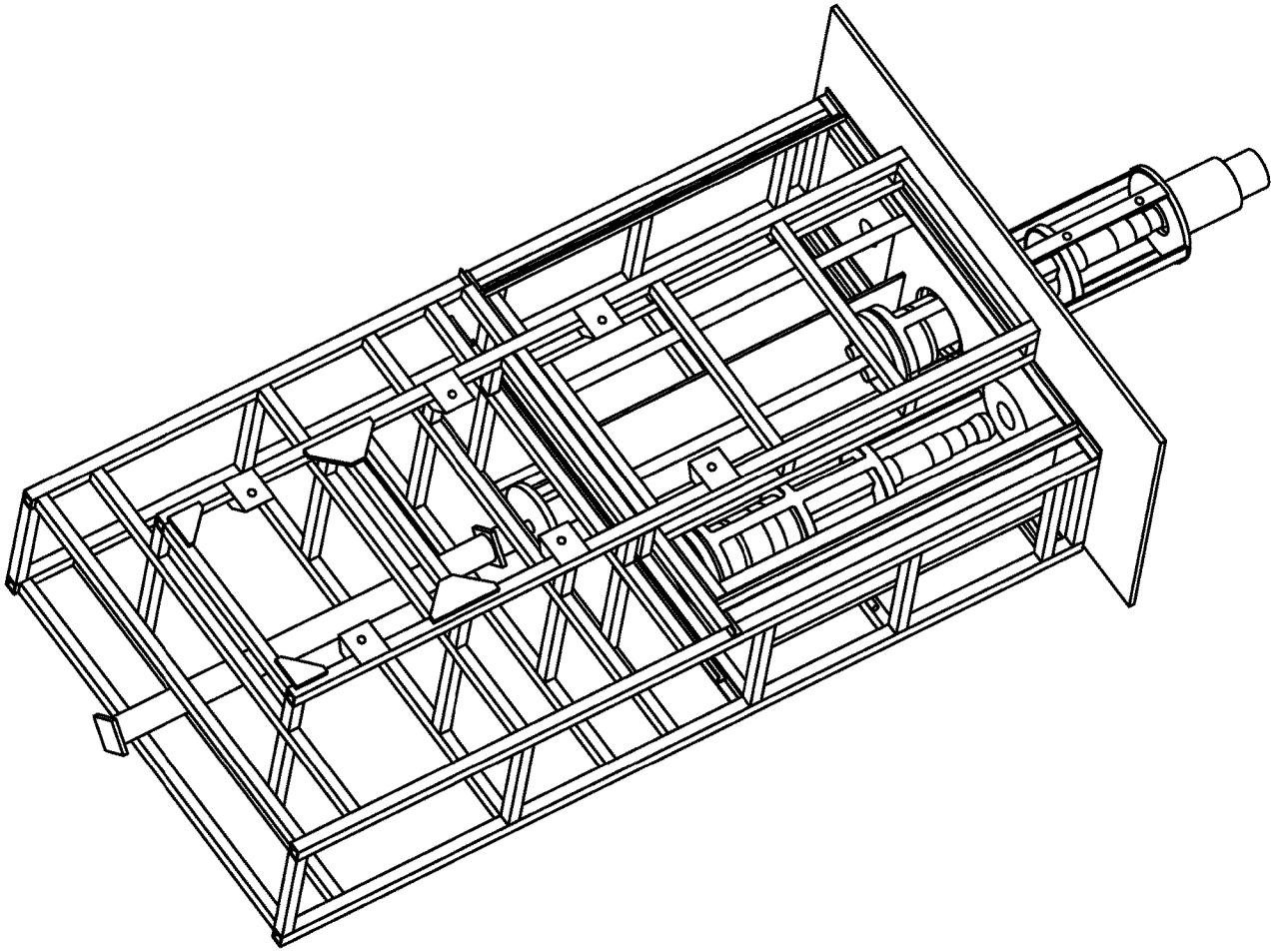
Figure 9:
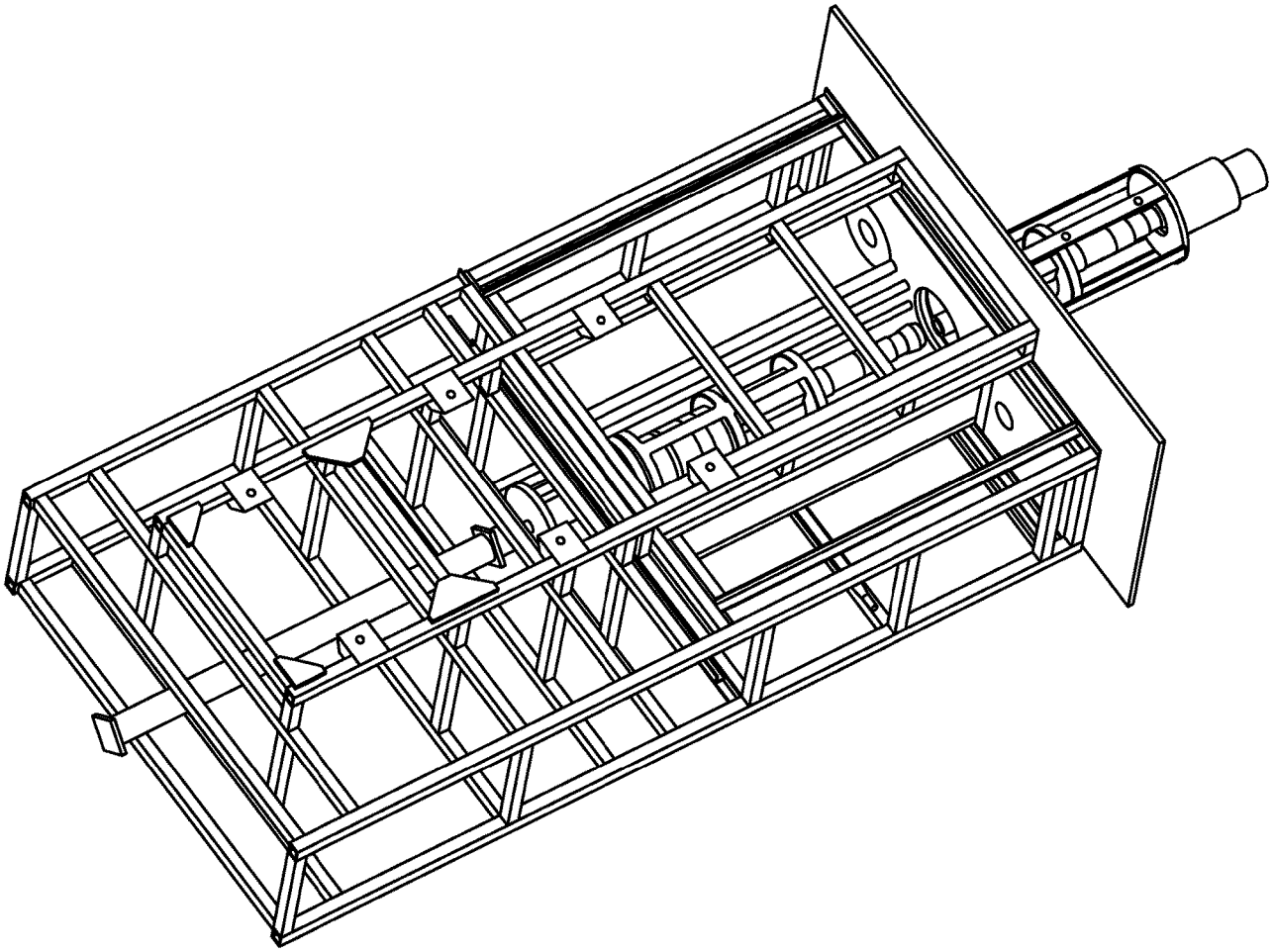

Subsea BOP module 120 may be configured to be received into a standard interface such as BOP module receiver 42 on subsea BOP 40, e.g. subsea BOP module 120 may comprise subsea modular BOP regulator 201 (FIG. 3) configured to be received into a standard modular BOP regulator interface such as BOP module receiver 42 on a subsea BOP.

Each subsea BOP module 120 may also comprise a predetermined set of BOP function controllers, such as a BOP electrical function controller, a BOP hydraulic function controller, or the like, or a combination thereof. It is understood that because subsea BOP module 120 can comprise one or many different function controllers, standard modular BOP regulator interface can comprise a corresponding set of function controller receivers and is not limited to BOP module receiver 42.

In certain configurations, subsea BOP module 120 (shown in FIG. 2 as regulator replacement assembly 200) further comprises inductive coupling 203 configured to operatively couple with corresponding inductive coupling 43 in BOP module receiver 42, thus eliminating the need for wet electrical connectors between subsea BOP module 120 and BOP electrical connectors.

Subsea modular BOP regulator 200 may further comprise solenoid actuated valve module 205, which may further comprise onboard electronics configured to monitor and control at least one of a pilot valve and a pilot pressure transducer, and pilot valve actuated valve module 206, which may further comprise onboard electronics configured to read back and pilot pressure transducer.

In the operation of a preferred embodiment, referring still to FIG. 2 and referring additionally to FIGS. 4-9, modules that are used to control functions on subsea hardware such as BOP 40 may fail or are no longer communicating with a communications receiver such as one at the surface. One or more subsea BOP modules 120 (shown in FIG. 2 as regulator replacement assembly 200) into BOP 40 via ROV 20 into a desired standard interface such as BOP module receiver 42 by using retrievable module assembly 10, which is described above. Once installed, subsea BOP module 120 can then establish electrical and/or hydraulic communications to address the failed control function module.

Retrievable module assembly 10 is typically maneuvered proximate BOP 40 which comprises one or more standard interfaces such as subsea modular BOP regulator receivers 42. Retrievable module assembly 10 may also be secured to BOP 40 for stability and alignment using connector 170 (FIG. 1).

Rotator 140 is maneuvered and attached to subsea BOP module 120, and then rotator 130 maneuvered to where it can position subsea BOP module 120 proximate a predetermined BOP standard interface such as such as BOP module receiver 42, typically linearly. If needed, rotator 130 can rotate the attached subsea BOP module 120 until subsea BOP module 120 is in aligned with and in a position suitable for insertion into the predetermined BOP standard interface.

Once positioned and rotated, if necessary, the attached subsea BOP module 120 is advanced and secured into the predetermined BOP standard interface such as a predetermined BOP module receiver 42. Once secured into the predetermined BOP standard interface, the attached subsea BOP module 120 is released from rotator 130.

At times it will be necessary to use rotator mover 140 to retrieve rotator 130 back into frame 100 after the attached subsea BOP module 120 is released from rotator 130. At other times, it is desirable to remove an existing subsea module 120 from BOP 40. In those situations, prior to attaching subsea BOP module 120 to rotator 130, rotator 130 is advanced towards a predetermined BOP standard interface, such as BOP module receiver 42 which houses the existing subsea BOP module 120, and attached to the existing subsea BOP module 120. Using rotator 130, the existing subsea BOP module 120 is then disengaged from the BOP standard interface and, once disengaged, retracted along with rotator 130 into a desired tray 110 in frame 100. Once retracted to an advantageous position, the extracted subsea BOP module 120 may be stored into an empty tray space 112 in tray 110.

In certain embodiments, removal of existing subsea BOP module 120 and installation of a new subsea BOP module 120 are accomplished in a single subsea trip or in multiple subsea trips.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A retrievable module assembly, comprising:

a. a frame configured to house and support a subsea blowout preventer (BOP) module adapted to be operatively received into a corresponding BOP module receiver of a BOP disposed subsea, the frame further comprising a remotely operated vehicle (ROV) mount adapted to mate with a corresponding ROV mount receiver attached to an ROV; and b. a modular storage unit disposed at least partially within the frame, the modular storage unit further comprising:

i. a storage area configured to removably accept the subsea BOP module;

ii. a rotator configured to attach to and rotationally align the subsea BOP module into a position suitable for insertion the subsea modular BOP receiver, the rotator disposed at least partially within the frame;

iii. a rotator mover, slidably mounted in the frame and operatively in communication with the rotator;

iv. a motor operatively connected to the rotator mover and operative to selectively rotate the rotator; and v. a power connector operatively connected to the rotator and rotator mover and configured to interface with a power source.

2. The retrievable module assembly of claim 1, further comprising a connector configured to secure the retrievable module assembly to a corresponding subsea structure.

3. The retrievable module assembly of claim 2, wherein the connector further comprises:

a. a primary lock; and b. a secondary dock lock configured to aid in securing the retrievable module assembly to the BOP.

4. The retrievable module assembly of claim 1, further comprising a flotation module disposed at least partially within the frame, the flotation module configured to provide additional buoyancy to the retrievable module assembly.

5. The retrievable module assembly of claim 1, wherein the ROV mount comprises a towline mount adapted to mate with a corresponding towline connected to an ROV.

6. The retrievable module assembly of claim 1, wherein the rotator mover further comprises a rail configured to slidably accept the rotator mover, wherein the motor is operatively connected to the rotator mover.

7. The retrievable module assembly of claim 1, wherein:

a. the modular storage unit comprises a plurality of storage areas configured to removably accept a corresponding plurality of subsea BOP modules; and b. the rotator is configured to selectively attach to and rotate a predetermined one of the plurality of subsea modules.

8. The retrievable module assembly of claim 1, wherein the rotator is further configured to selectively store a retrieved subsea module into the storage area.

9. The retrievable module assembly of claim 1, wherein the subsea BOP module comprises a subsea modular BOP regulator configured to be accepted into a subsea modular BOP regulator receiver subsea.

10. The retrievable module assembly of claim 9, wherein the subsea modular BOP regulator receiver comprises a standard subsea BOP interface.

11. A system for manipulating a blowout preventer regulator subsea, comprising:

a. a modular subsea blowout preventor (BOP) regulator configured to be accepted into a BOP regulator receiver disposed subsea;

b. a power source;

c. a retrievable module assembly, comprising:

i. a frame configured to house and support a modular BOP regulator; and ii. a modular storage unit disposed at least partially within the frame, the modular storage unit further comprising:

1. a storage area configured to removably accept the modular BOP regulator;

2. a rotator configured to attach to and rotationally align the modular BOP regulator into a position suitable for insertion the subsea modular BOP regulator receiver, the rotator disposed at least partially within the frame;

3. a rotator mover, slidably mounted in the frame and operatively in communication with the rotator;

4. a motor operatively connected to the rotator mover and operative to selectively rotate the rotator; and 5. a power connector operatively connected to the rotator, the rotator mover, and the power source.

12. The system of claim 11, wherein the subsea modular BOP regulator is configured to be received into a standard regulator interface on a subsea BOP.

13. A method of installing a modular BOP regulator subsea, comprising:

a. installing a subsea modular BOP regulator into a retrievable module assembly, the regulator assembly comprising:

i. a frame configured to house and support the subsea modular BOP regulator; and ii. a modular storage unit disposed at least partially within the frame, the modular storage unit further comprising:

1. a storage area configured to removably accept the subsea modular BOP regulator;

2. a rotator configured to attach to and rotationally align the modular BOP regulator into a position suitable for insertion the subsea modular BOP regulator receiver, the rotator disposed at least partially within the frame;

3. a rotator mover, slidably mounted in the frame and operatively in communication with the rotator;

4. a motor operatively connected to the rotator mover and operative to selectively rotate the rotator; and 5. a power connector operatively connected to the rotator and rotator mover and configured to interface with a power source;

b. maneuvering the retrievable module assembly proximate a subsea blowout preventer (BOP), the BOP comprising a subsea modular BOP regulator receiver;

c. attaching the subsea modular BOP regulator to the rotator;

d. positioning the rotator and attached subsea modular BOP regulator proximate the BOP modular regulator receiver;

e. using the motor to rotate the rotator to rotate the attached subsea modular BOP regulator until it is aligned with and in a position suitable for insertion of the attached subsea modular BOP regulator into the subsea modular BOP regulator receiver;

f. advancing the attached subsea modular BOP regulator into the subsea modular BOP regulator receiver;

g. securing the attached subsea modular BOP regulator in the subsea modular BOP regulator receiver;

h. releasing the attached subsea modular BOP regulator from the rotator;

i. attaching the retrievable module assembly to a remotely operated vehicle (ROV);

j. using the ROV to maneuver the retrievable module assembly subsea to a desired position proximate the BOP;

k. attaching retrievable module assembly to a towline; and l. using the towline to maneuver the retrievable module assembly subsea.

14. The method of claim 13 further comprising using the rotator mover to retrieve the rotator back into the frame after the releasing the attached subsea modular BOP regulator from the rotator.

15. The method of claim 13, further comprising:

a. prior to attaching the subsea modular BOP regulator to the rotator, advancing the rotator towards the subsea modular BOP regulator receiver;

b. attaching the rotator to an existing subsea modular BOP regulator installed in the subsea modular BOP regulator receiver;

c. disengaging the existing subsea modular BOP regulator from the subsea modular BOP regulator receiver;

d. retracting the rotator back into the frame; and e. storing the extracted existing subsea modular BOP regulator into an empty space in the modular storage unit.

16. The method of claim 15, wherein the removal of the existing subsea modular BOP regulator and the installation of the new subsea modular BOP regulator are accomplished in multiple subsea trips.

17. The method of claim 15, wherein the removal of the existing subsea modular BOP regulator and the installation of the new subsea modular BOP regulator are accomplished in a single trip.

18. The method of claim 13, wherein attachment of the retrievable module assembly to the ROV is accomplished by mounting the retrievable module assembly to the bottom of the ROV or to an ROV cage.

19. The method of claim 13, further comprising using the ROV or the ROV cage to provide power to the retrievable module assembly.

* * * * *